US006913799B2

(12) United States Patent
Brundula et al.

(10) Patent No.: US 6,913,799 B2
(45) Date of Patent: Jul. 5, 2005

(54) GOLF TURF AND METHOD OF MANUFACTURING SAME

(75) Inventors: William Brundula, Kirtland, OH (US); James R. Brundula, Mayfield Hts., OH (US)

(73) Assignee: Bruns Brush Inc., Willoughby, OH (US)

( * ) Notice: Subject to any disclaimer, the term of this patent is extended or adjusted under 35 U.S.C. 154(b) by 7 days.

(21) Appl. No.: 10/324,835

(22) Filed: Dec. 20, 2002

(65) Prior Publication Data

US 2004/0121090 A1 Jun. 24, 2004

(51) Int. Cl.[7] ..... E10C 13/08

(52) U.S. Cl. ..... 428/17; 428/85; 428/97; 29/428; 29/469; 29/469.5; 29/505

(58) Field of Search ..... 428/17, 15, 85, 428/97; 29/59.2, 428, 469, 469.5, 505

(56) References Cited

U.S. PATENT DOCUMENTS

| | | | | | |
|---|---|---|---|---|---|
| 3,940,522 | A | * | 2/1976 | Wessells | 428/17 |
| 4,498,708 | A | * | 2/1985 | Bromboz | 300/2 |
| 4,808,446 | A | * | 2/1989 | Weitz | 428/17 |
| 5,004,243 | A | * | 4/1991 | Dlouhy | 473/279 |
| 5,292,130 | A | * | 3/1994 | Hooper | 473/279 |
| 5,885,168 | A | | 3/1999 | Bair | |
| 6,139,443 | A | | 10/2000 | Reynolds | |
| 6,155,931 | A | | 12/2000 | Perrine | |
| 6,551,689 | B1 | * | 4/2003 | Prevost | 428/143 |
| 6,800,339 | B2 | * | 10/2004 | Motz et al. | 428/17 |

OTHER PUBLICATIONS

Merriam–Webster's Collegiate Dictionary, 1999, 10$^{th}$ Edition, p. 144.*

* cited by examiner

*Primary Examiner*—Jennifer McNeil
(74) *Attorney, Agent, or Firm*—Woodling, Krost and Rust

(57) ABSTRACT

Golf turf is disclosed and claimed herein which simulates fairway, rough or putting green surfaces. Golf clubs which strike the golf turf disclosed herein do not experience the shock of typical golf mats made from Astroturf® and the like, lessening fatigue and preventing injury to the elbow and wrist. Crimped filaments made of synthetic resinous fibers are used to make strip brushes having flared end portions which form a homogeneous surface. Receiving slots in a substrate retain a plurality of strip brushes spaced apart and parallel to each other. The strip brushes are configured to simulate homogeneous surfaces which approximate actual golf surfaces.

20 Claims, 12 Drawing Sheets

GOLF TURF AND METHOD OF MANUFACTURING SAME

FIELD OF THE INVENTION

This invention is in the field of artificial golf surfaces otherwise known as artificial golf turf.

BACKGROUND OF THE INVENTION

It is desired to have an artificial golf surface which simulates actual golf course turf. Golf has become a popular sport which is played in all 12 months of the year in some locations. In northern climates it is necessary to practice golf indoors for obvious reasons. It is desirable, therefore, to play indoors with conditions which simulate actual golf.

Further, for outdoor golf practice ranges with heavy traffic it is difficult to keep the grass in good shape. Too many players taking too many divots results in practice ranges with little or no turf left. It is, therefore, desirable to practice golf on artificial golf turf surfaces at practice ranges or warm-up areas which are outdoors. It is desirable, therefore, to have artificial golf turf outdoors for practice ranges or warm-up areas which emulates actual golf surfaces, namely, fairway surfaces, rough surfaces, putting surfaces and tees.

When playing golf on an outdoor course, natural grass and grass roots and dirt beneath the roots succumb to the force of a golf club and a divot is taken. A divot is the grass and root system of the grass which is sliced away or cutaway by a golf "iron." When using an iron a divot is sometimes intentionally taken so as to impart a certain spin on the golf ball which will affect its flight and/or its response when it comes down to the golf course.

The difference between a properly hit iron shot and a poorly hit iron shot is sometimes expressed by whether or not the golf ball is hit first and then a divot is taken beneath the ball and/or beneath the grass immediately in front of the golf ball. If the divot is taken too far behind the golf ball then the shot will be a poor one and the shot is said to have been hit "fat."

When a player hits behind the golf ball it is known as hitting the ball "fat." When a golf ball is hit fat it usually doesn't go too far because the golf club first contacts the grass too far behind the golf ball followed by the roots of the grass and dirt and/or whatever material lies beneath the grass at that particular point on the course or practice range. A fat golf shot can sometimes result in the grass being compressed between the golf club and the golf ball.

In any event it is quite common to hit down into the ball properly and/or to hit the ball fat. Missing a ball by striking it too high on the ball results in the ball being driven down into the grass and the material beneath the grass. This is known as topping the golf ball. Actual golf surfaces such as the fairway or rough are grass surfaces with material underneath which provide some relief or cushion when a ball is driven into it.

There is a need for an artificial golf surface which approximates the actual conditions of golf, namely, a grass like surface which has the ability to cushion a golf club which necessarily must engage the surface. There is a need for artificial golf turf which approximates actual golf turf. It is necessary for golfers to hit down into a golf ball and into the turf in proximity to the golf ball.

In certain circumstances a golfer may desire to "pick" the golf ball from the playing turf so as to generate a particular flight or action on the golf ball. By "pick" it is meant that the club does not hit the grass beneath the ball or that the club does not hit much into the grass. For instance, shots employing woods or long irons may require that the golfer pick them from the turf.

Therefore, it is desirable that the golf ball be supported by the artificial golf turf so that it may be "picked" from the surface with the appropriate golf club or with the appropriate technique of the golfer. It is desirable that artificial golf turf be capable of allowing the golfer to make the kind of shot that s/he wishes and to approximate the look and feel of real golf turf.

Related Art patents are now discussed. U.S. Pat. No. 6,155,931 to Perrine issued Dec. 5, 2000 discloses a golf swing practice mat for placement on an underlying base to aid a golfer in improving the golfer's swing. The golf swing practice mat comprises a low friction, flexible and resilient top sheet that is contacted by the golf club. The top sheet has a rigidity of 40 pounds per square inch or less and has an underlying supporting pad for supporting the top sheet and for providing space for the top sheet to move under force of the club. The support pad is compressible to 50% of its resting height in any area near its center line by an applied pressure of 8 psi or less. A bottom sheet is used underneath the support pad.

U.S. Pat. No. 6,139,443 to Reynolds issued Oct. 31, 2000 and discloses a turf-simulating surface. The device is made of components which simulate the layers of natural soil according to the patent. One component is a composite mat having an integral pile section having tufted strands that simulate grass and a plastic foam layer. A lateral-strength fabric is used with the pile section which has loops which interact with the lateral-strength fabric. The plastic foam layer is bonded to the lateral-strength fabric and the looped regions of the pile section. A rimmed base is integrally formed around a composite core.

U.S. Pat. No. 5,885,168 to Bair issued Mar. 23, 1999 and discloses mats which are plastic brush mats with plastic tufts embedded in a plastic base. The mats have regions or panels of different pile depth and density for simulating different types of playing surfaces.

A better understanding of the invention will be had when reference is made to the Summary of the Invention, Brief Description of the Drawings, Description of the Invention and Claims which follow hereinbelow.

SUMMARY OF THE INVENTION

Golf turf comprising a substrate and a plurality of brush elements retained by said substrate is disclosed and claimed. Each of the brush elements are spaced apart from one another and oriented parallel to each other. Each of the brush elements include filaments, a metal housing and wire for retaining said filaments. The filaments extend outside the metal housings and they flare as they extend outside the metal housing. Preferably the filaments are crimped which increases the degree of the flare.

The filaments of each brush interengage the filaments of the adjacent brush. Each of the filaments has a diameter in the range of 0.006 to 0.020 inches. Preferably the filaments are 0.006 inches in diameter and are crimped in a general sinusoid having a frequency of 3 cycles per inch. Alternatively, the filaments may be crimped in a general sinusoid having a frequency considerably higher than 3 cycles per inch. Further, it is specifically contemplated by this invention that crimping patterns other sinusoids may be employed.

A process for making golf turf comprising the steps of: forming brush strips from crimped filaments; inserting the brush strips in a substrate; and, locking the brush strips in the substrate is disclosed and claimed. The step of forming the brush strip includes the steps of laying a flat piece of metal on a surface; placing synthetic resinous filaments on the flat piece of metal; placing a wire on top of the filaments; and, deforming the flat piece of metal into a housing so as to entrap the filaments and wire within the housing.

Preferably the brush strips are mounted in a relatively heavy substrate which can be made of plastic or some metal which has been treated so as to not corrode. The brush strips are preferably oriented parallel to one another although other arrangements are specifically contemplated by this disclosure. The spacing between the parallel brush strips is important because the strips support each other when deformed under the influence of a golf club. Further proper spacing between the parallel strips is important because the crimped filaments of the brush strips flare as a function of the filament used together with the amount of compression applied by the metal housing of the brush strip. Still further the spacing of the brush strips is important as drainage of water is permitted on the lands of the substrate between the parallel brush strips.

Golf clubs which strike the golf turf disclosed herein do not experience the shock of typical golf mats made from Astroturf® and the like, lessening fatigue and preventing injury to the elbow and wrist. Southwest Recreational Industries, Inc. 701 Leander Drive Leander, Tex. is the owner of the trademark registration Astroturf®.

It is an object of the present invention to provide an artificial golf turf which simulates actual golf turf.

It is an object of the present invention to provide an artificial golf turf which enables the golfer to use an iron which deforms the turf and provides a cushioning effect when the golf club passes through the turf.

It is an object of the present invention to provide an artificial golf turf which is resilient and does not permanently deform.

It is an object of the present invention to provide an artificial golf turf which gives the appearance and feel of actual golf turf.

It is an object of the present invention to provide an artificial golf turf which has a homogeneous surface.

It is an object of the present invention to provide an artificial golf turf which is durable and long-lasting.

Further objects of the present invention will be understood when reference in made to the Brief Description of the Drawings, Description of the Invention and Claims which follow hereinbelow.

The drawings will be best understood when reference is made to the following Description of the Invention and Claims which follow hereinbelow.

DESCRIPTION OF THE INVENTION

Figure 1:
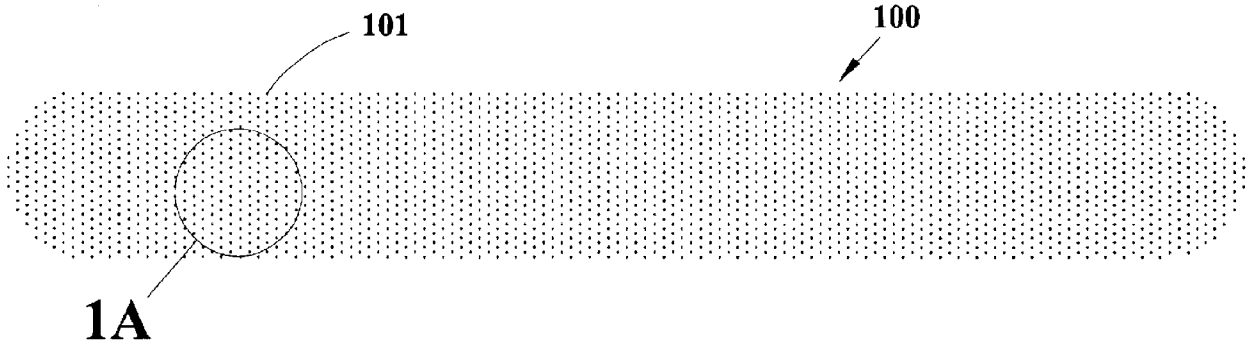
FIG. 1 is an enlarged schematic top view of one of the brush elements.
Figure 1A:
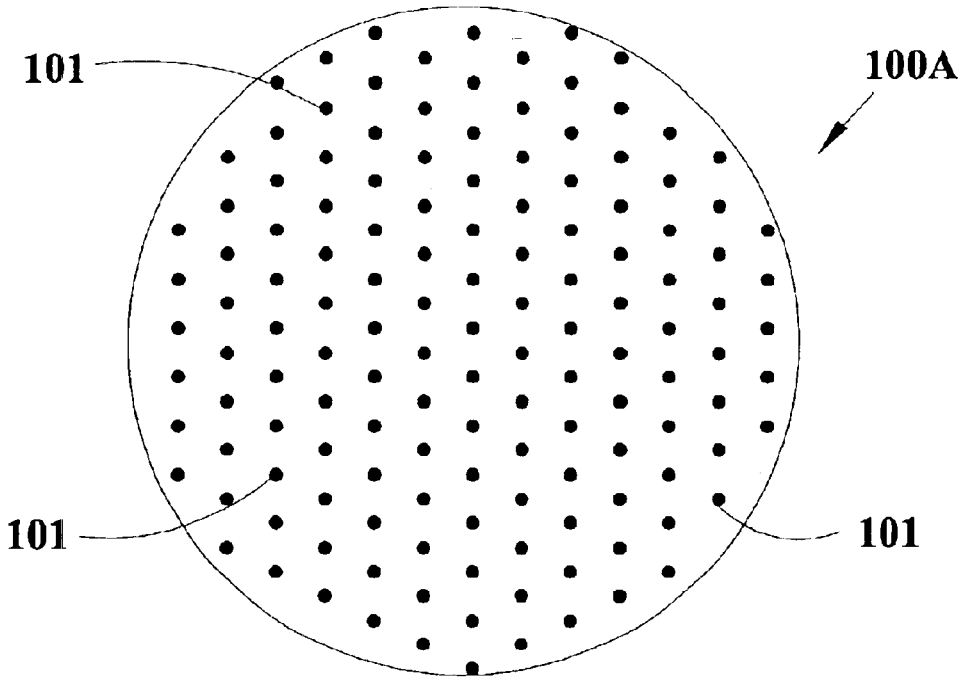
FIG. 1A is enlarged portion of FIG. 1.
Figure 5:
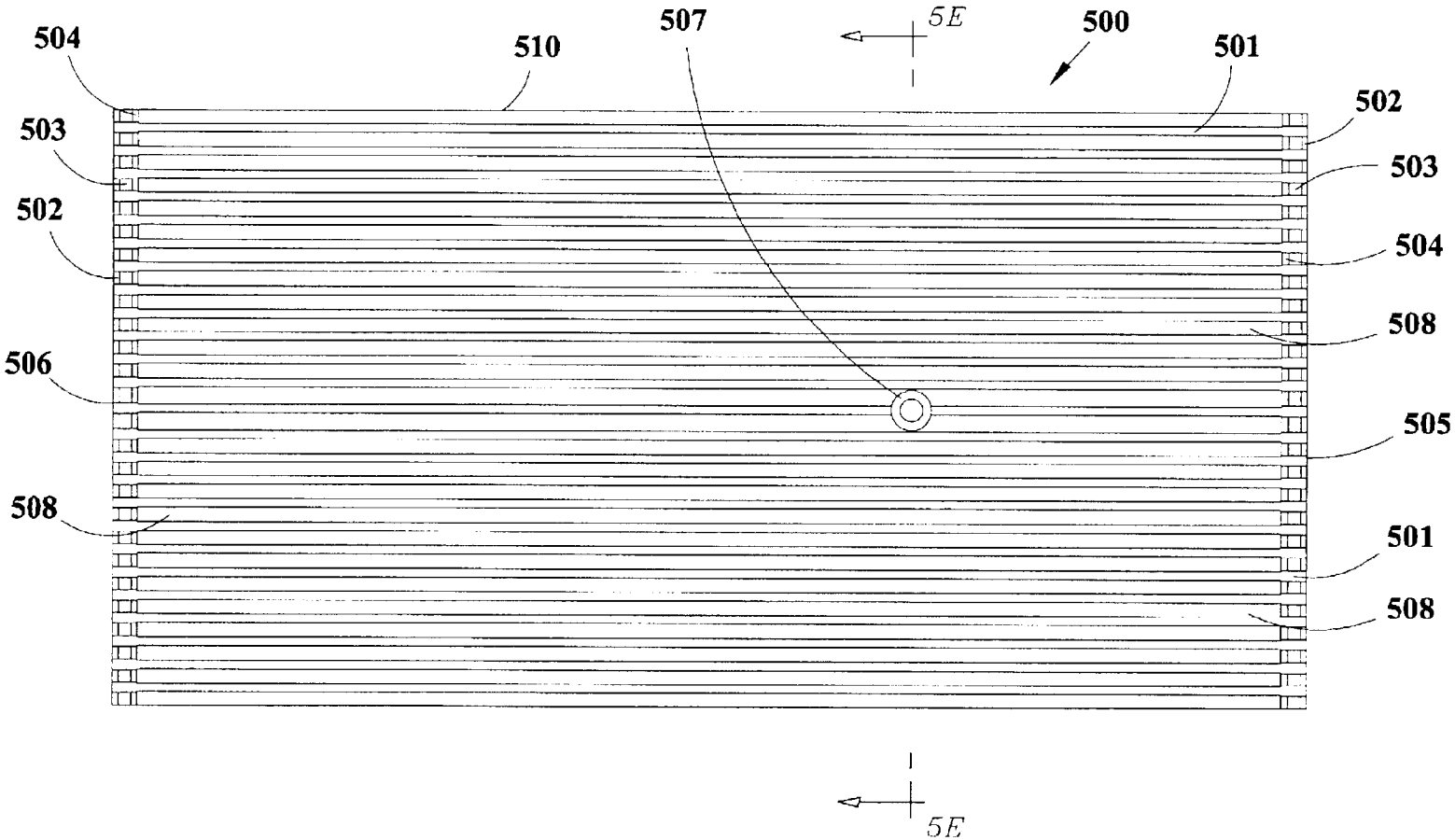
FIG. 5 is a top view of the substrate in which a plurality of brush elements reside.

FIG. 1 is an enlarged schematic top view of one of the brush elements 100. Individual crimped filaments 101 are illustrated schematically in FIG. 1. In reality a top view of a brush element is opaque because the individual filaments are spaced very closely together and form a homogeneous surface which resembles grass when the filaments are colored green. See FIG. 5G, a front view 500G of the substrate of FIG. 5 illustrating the end latches 516, a brush element 100 which is illustrated as solid black and a tee 902. FIG. 1A is enlarged portion 100A of FIG. 1 illustrating individual filaments 101.

Figure 2:
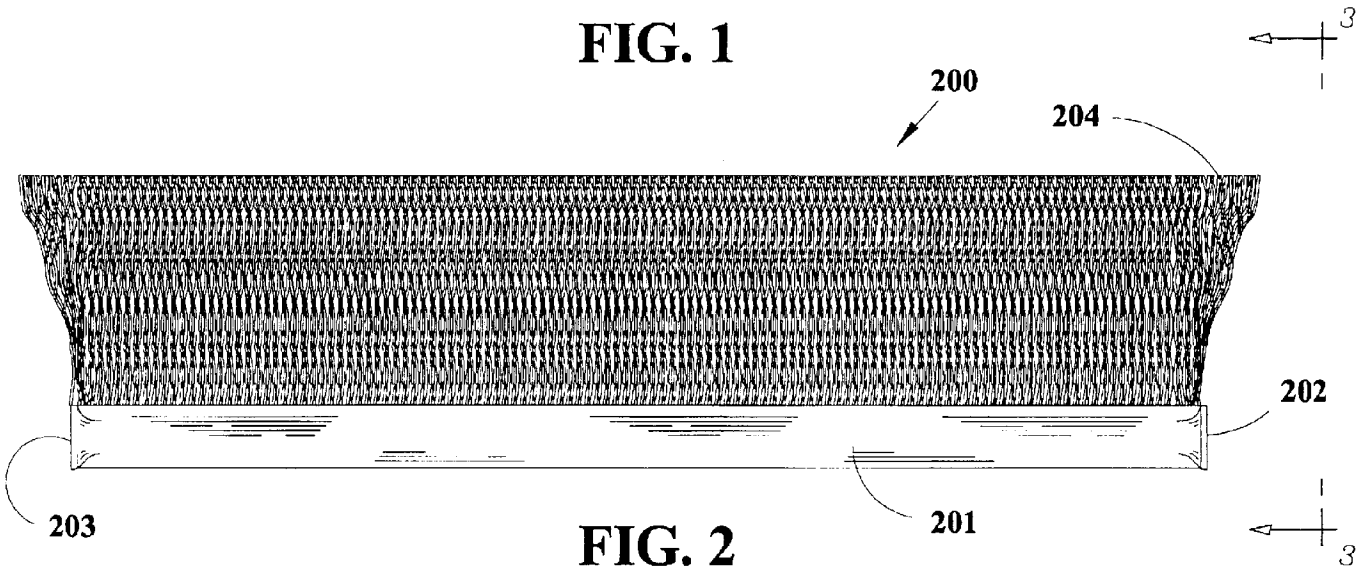
FIG. 2 is an enlarged schematic front view of the brush element of FIG. 1 illustrating a portion of the crimped filaments of the brush.

FIG. 2 is an enlarged schematic front view 200 of the brush element 100 of FIG. 1 illustrating a portion of the crimped filaments 101 of the brush. Metal brush housing 201 is a non-corrosive deformable metal which secures as will be explained hereinbelow the individual crimped filaments 101 of the brush elements 100. At the ends of the brush element or strip 100, crimped elements 204 show the periodicity of the crimped filaments. Metal housing 201 includes deformed end portions 202, 203. Preferably the brush elements 100 are approximately two (2) feet long but other lengths are specifically contemplated by the disclosure herein. Those skilled in the art will readily recognize that different lengths may be employed such that artificial surfaces 10 feet long or longer may be constructed. Further, since the structure described herein provides a homogeneous artificial turf surface, sections thereof may be employed so that the extent of the artificial surface is virtually unlimited. It is necessary to understand in connection with FIG. 2 that it is a schematic only for describing the invention such that it will be understood. The nature of the crimped filaments is represented by reference numeral 204. In reality, a side view of a brush element and filaments thereof would be opaque as viewed in FIG. 5G.

Figure 3:
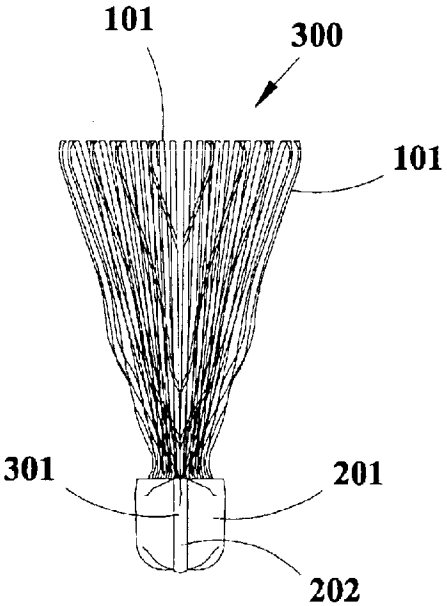
FIG. 3 is a schematic end view of the end of the brush element of FIG. 1 illustrating a portion of the crimped filaments of the brush.

FIG. 3 is a schematic end view 300 of the end of the brush element 100 of FIG. 1 illustrating a portion of the crimped filaments of the brush. By portion it is meant that the crimped nature of the individual filaments 101 is illustrated otherwise the end view of the brush element would be opaque because the crimped filaments 101 are spaced very closely together. A slight opening or crack 301 is illustrated in FIG. 3 which is a result of the forming process for metal housing 201.

The crimped filaments 101 are a synthetic resinous material such as nylon or polyester and are available from Specialty Filaments, Inc. located in Vermont. Preferably, the diameter of the crimped filaments are 0.006 inches and are nominally crimped with a frequency of 3 cycles per inch or 3 waves per inch. The amplitude of the crimped filaments 101 may be nominally 0.012 inches. Different filaments having different amplitudes may be used. Different diameter filaments may be used in the range of 0.006 inches to 0.020 inches. As the diameter of the filament increases the amplitude of the waves also increases for a given crimp frequency. The disclosure set forth herein is given by way of example only and those skilled in the art will readily recognize that different crimped filaments may be used having different features (including different diameters, amplitudes and crimped frequencies) without departing from the spirit and scope of the appended claims.

Figure 4A:
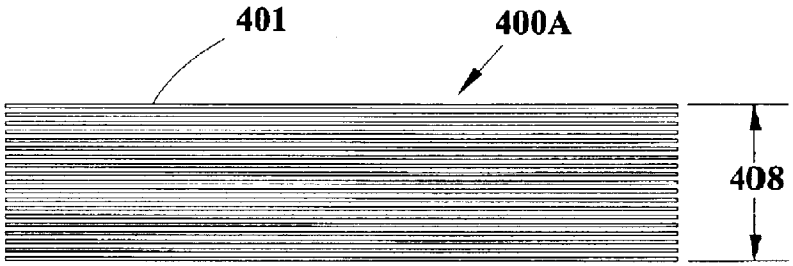
FIG. 4A is a schematic front view of a stack of straight filaments.
Figure 4B:
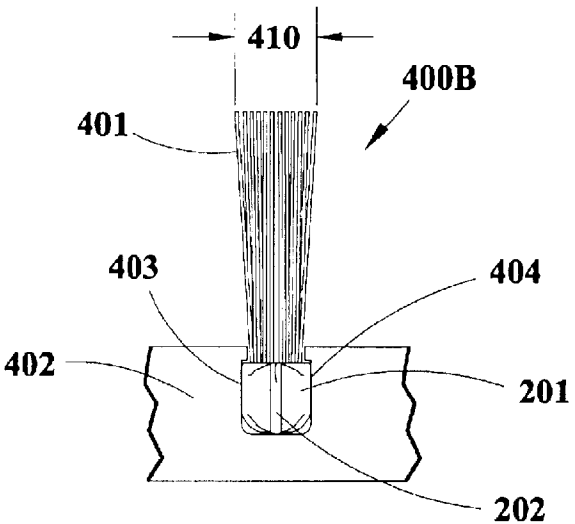
FIG. 4B is a schematic end view of a brush element having straight filaments in a substrate.

FIG. 4A is a schematic front view 400A of a stack of straight filaments 401. Although straight filaments may be used they do not provide as much flare as crimped filaments provide as will be discussed hereinbelow. A stack of straight filaments renders a height as represented by reference numeral 408. The straight filaments 401 will compact together well because of their uniformity. It is this uniformity, however, which reduces the flare 410 in FIG. 4B which is a schematic end view 400B of a brush element having straight filaments 401 in a substrate 402. Again, as with the other drawing figures, FIGS. 4A and 4B illustrate only a portion of the filaments so as to depict their relationship to each other and their nature. Reference numeral 403 illustrates the channel in the substrate 402 and reference numeral 404 represents the engagement of the metal housing of the brush element with the channel 403 in the substrate 402.

Figure 4D:
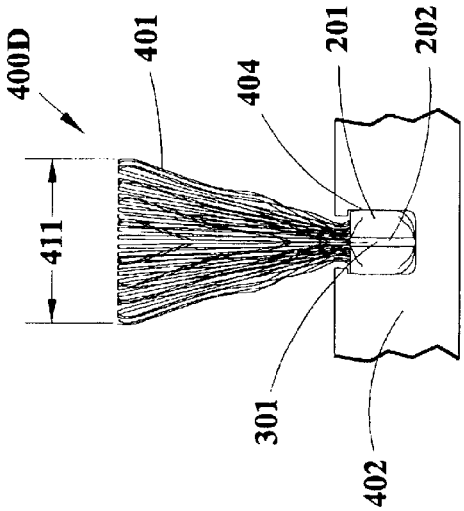
FIG. 4D is a schematic end view of a brush element having crimped filaments.
Figure 4E:
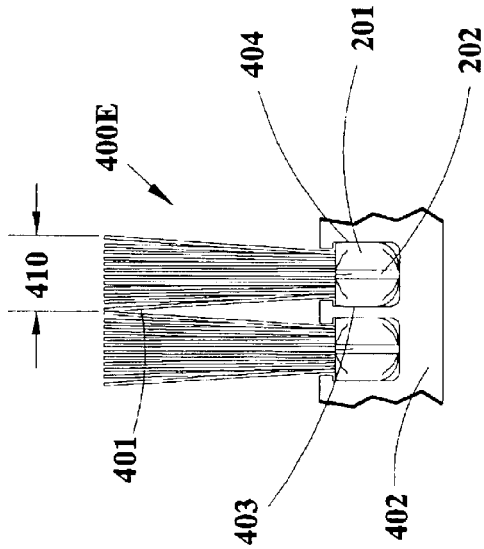
FIG. 4E is a schematic end view of two brush elements having straight filaments.
Figure 4C:
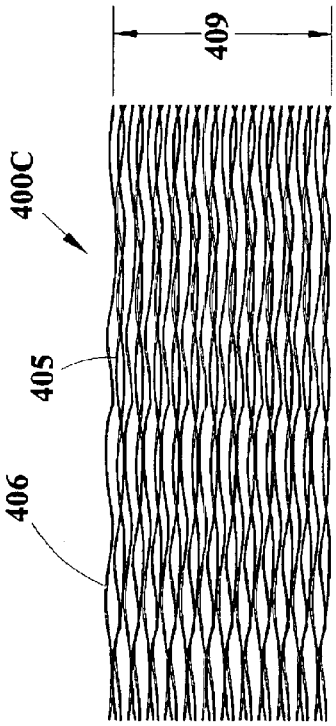
FIG. 4C is a schematic front view of a stack of crimped filaments.

FIG. 4C is a schematic front view 400C of a stack of crimped filaments 405/406. These filaments are arranged like crooked logs such that for the same number of straight filaments a larger height 409 is realized. Using crimped filaments results in a larger flare 411 as illustrated in FIG. 4D which is a schematic end view of a brush element having crimped fibers.

The amount of crimping pressure on housing 201 will influence the flare 411 of the crimped filaments as illustrated in FIG. 4D. The larger the crimping pressure the larger the flare within the limits as dictated by spatial restraints of the filaments. The filaments cannot be over stressed during crimping to form the metal housing 201 or the filaments will be broken. Again, drawing FIGS. 4C and 4D are schematics so as to depict the interrelationship of the filaments as discussed above in connection with the other drawing figures.

FIG. 4E is a schematic end view 400E of two brush elements having straight filaments arranged side by side in a substrate. Although not preferred because of their limited ability to flare, straight filaments are specifically contemplated by the disclosure and claims herein.

Figure 9A:
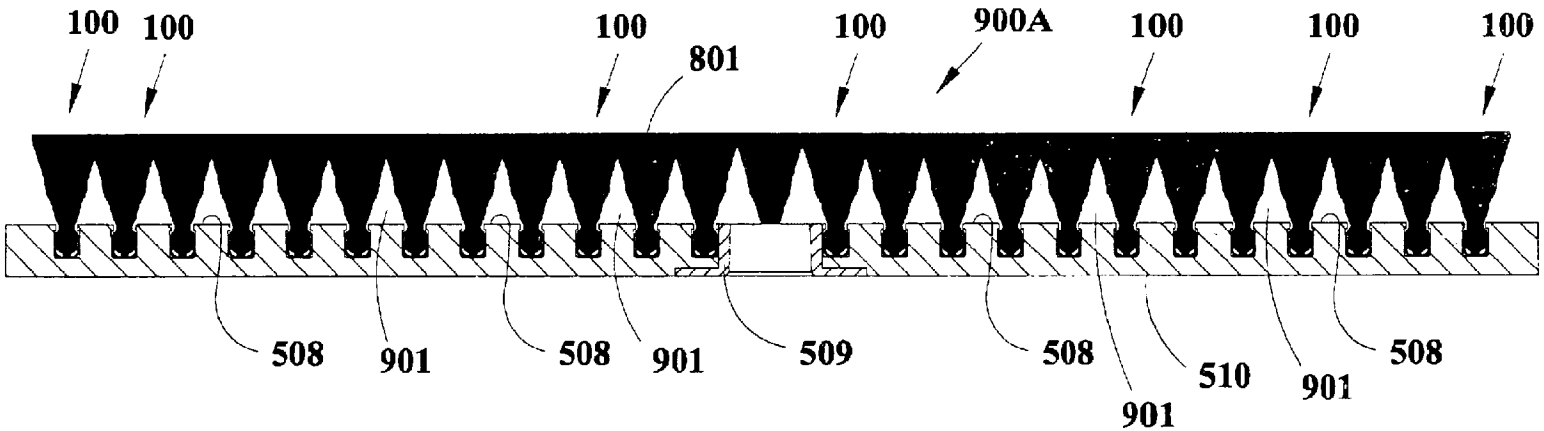
FIG. 9A is a cross-sectional view taken along the lines 9A—9A of FIG. 8 illustrating the brush elements forming a homogeneous surface.

FIG. 5 is a top view 500 of the substrate 510 in which a plurality of brush elements reside. FIG. 5 illustrates just the substrate 510 and not the brush elements in the substrate 510. Slots 501 engage the metal housings 201 as illustrated in FIG. 9A and secures them in place so that they may not be extracted therefrom. Although a plurality of slots 501 are used in the substrate 510 it is specifically contemplated by this invention that other ways of securing the strip brushes or elements 100 to a substrate of sufficient mass be used. For instance, the brush elements might be tack welded or secured with adhesive to the substrate.

Referring to FIG. 5, reference numeral 508 represents lands or raised flat spaces which reside between slots 501. Ends 505 and 506 of the substrate 510 have flat portions 502 proximate ends 505 and 506 of substrate 500. Lands 503 are raised for guiding end latches 516 as can be best viewed in FIG. 5B, an end view of the substrate of FIG. 5. Flat portions 504 proximate lands 508 guide end latch 516 as can be viewed in FIG. 5A. Bushing 507 for holding or assisting in holding a tee is also illustrated in FIG. 5.

Figure 5A:
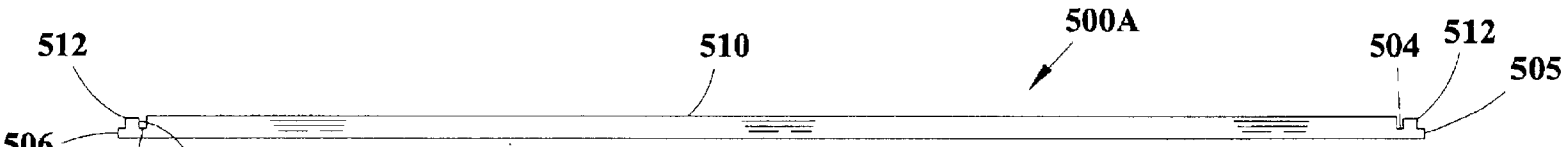
FIG. 5A is a front view of the substrate of FIG. 5.

FIG. 5A is a front view 500A of the substrate of FIG. 5 and illustrates the ends 505, 506 of the substrate together with knobs 512, 513 on lands 503. Also illustrated in FIG. 5A are the guiding surfaces 502 and 504 for the end latches 516. FIG. 5B is an end view 500B of one end 505 of the substrate 510 of FIG. 5 illustrating slots 501, lands 508 intermediate slots 501, end guide 502 and guide lands 503.

Figure 5C:
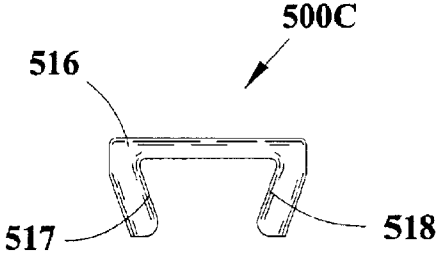
FIG. 5C is an end view of an end latch.
Figure 5B:
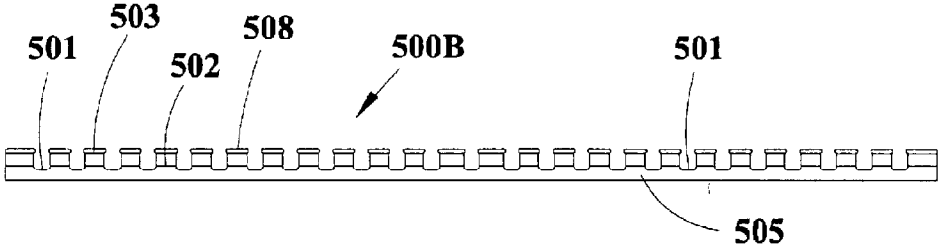
FIG. 5B is an end view of the substrate of FIG. 5.
Figure 5D:
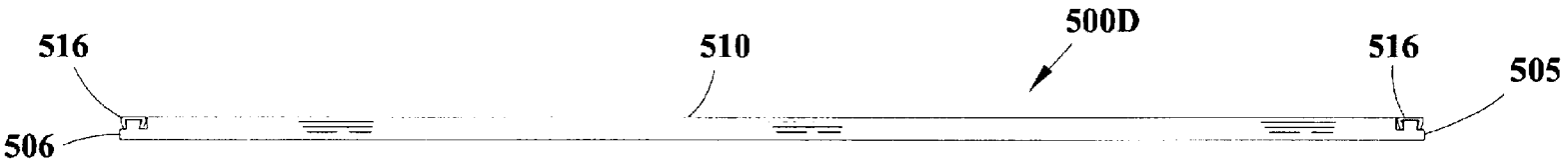
FIG. 5D is a front view of the substrate of FIG. 5 with the end latch.

FIG. 5C is an end view 500C of an end latch 516 illustrating legs 517 and 518 which interengage reciprocal knobs or protrusions 512, 513 of the substrate 510. FIG. 5D is a front view 500D of the substrate of FIG. 5 with the end latches 516 secured to each end 505, 506 of the substrate 510. End latches when secured in place as illustrated in FIG. 5G prevent the brush elements from being extracted from the substrate 510.

Figure 5E:
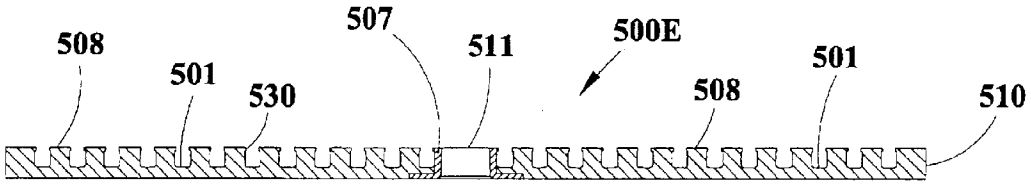
FIG. 5E is a cross-sectional view of FIG. 5 taken along the lines 5E—5E.

FIG. 5E is a cross-sectional view 500 E of FIG. 5 taken along the lines 5E—5E which illustrates slots 501 having lips 530 which prevent the metal housings of the brush elements from escaping out of the top of the slots. Also shown in FIG. 5E are the lands 508 intermediate the brush elements and the bushing 507 having top circumferential end portion 511.

Figure 5F:
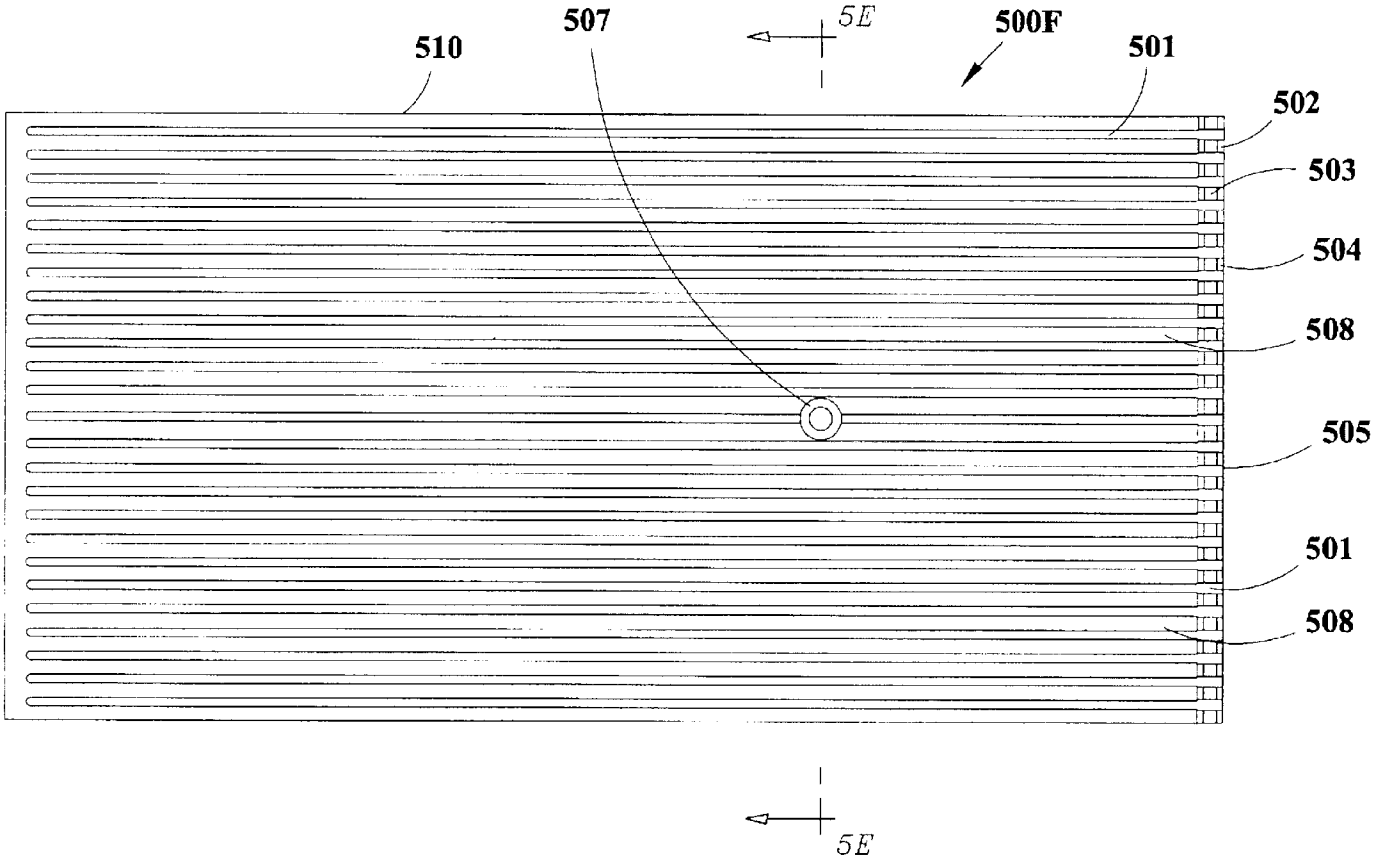
FIG. 5F is a top view of the substrate similar to FIG. 5 except having closed slots in which a plurality of brush elements reside.
Figure 5G:
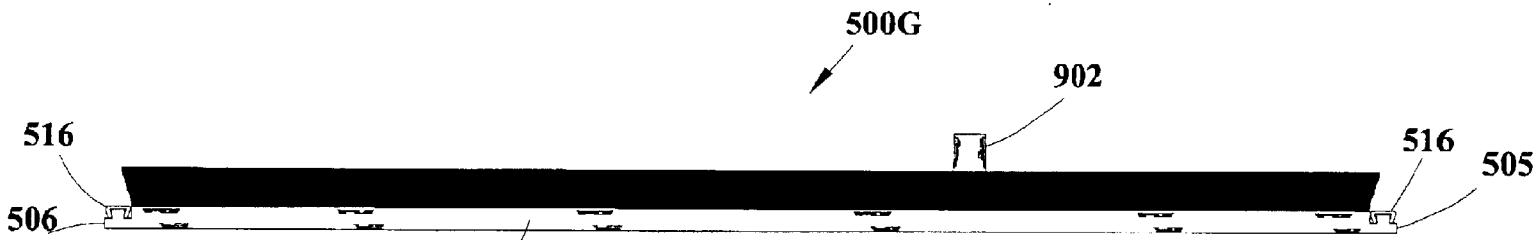
FIG. 5G is a front view of the substrate of FIG. 5 illustrating the end latches, a brush element and tee.
Figure 5H:
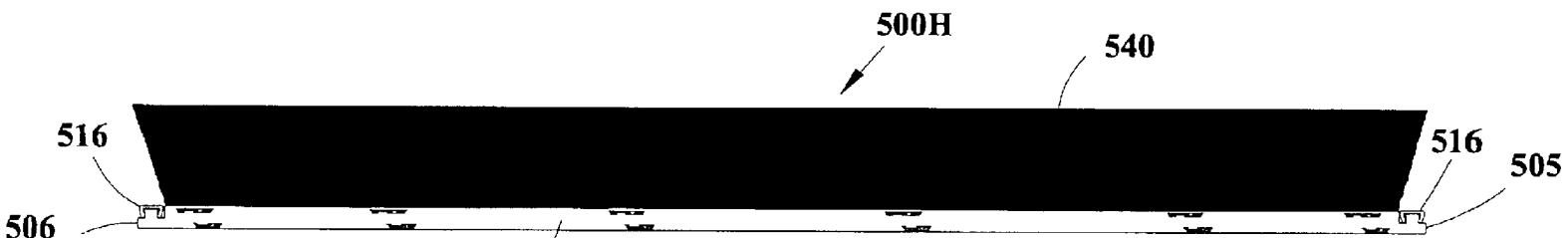
FIG. 5H is a front view of the substrate similar to that of FIG. 5G with a taller brush element illustrated.

FIG. 5F is a top view 500F of the substrate 510 similar to FIG. 5 except having closed slots 501 at one end thereof in which a plurality of brush elements reside. FIG. 5G is a front view 500G of the substrate of FIG. 5 illustrating the end latches 516, a brush element 100 and tee 902. FIG. 5H is a front view 500H of the substrate similar to that of FIG. 5G will a taller brush element illustrated. The brush elements are comprised of filaments as set forth above. The characteristics of the filaments are selected so as to emulate actual turf. For instance, a stiffer and shorter filament may be used to emulate a putting surface because putting surfaces usually have grass which is mown to a very short height. Longer and thicker filaments may be used to emulate the rough on a golf course.

Figure 7:
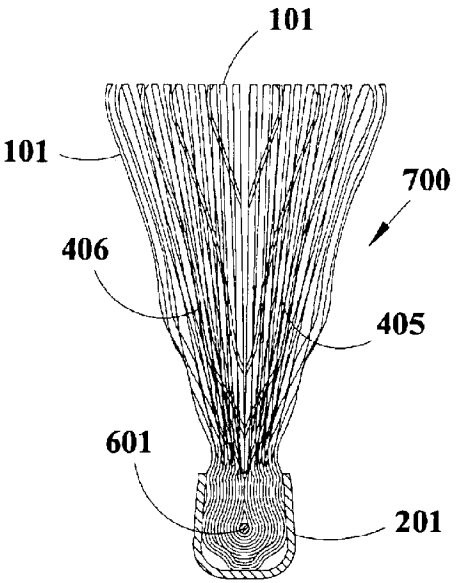
FIG. 7 is a schematic cross-sectional view of the crimped filaments together with the deformed metal housing and wire of FIG. 6.
Figure 6:
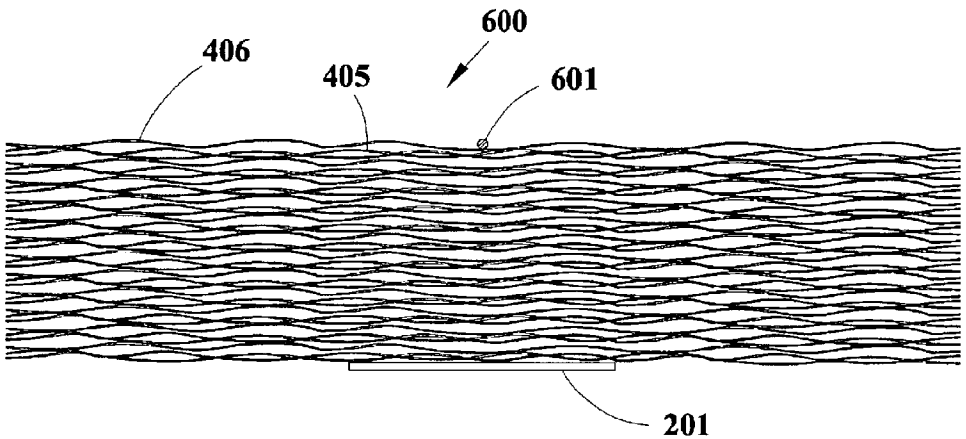
FIG. 6 is a schematic view of a stack of crimped filaments resting on a metal housing and a wire placed on the stack of crimped filaments prior to bending and deforming the metal housing.

Fairway turf is emulated by the brush elements 100 depicted herein which have a height of approximately 0.75 inches above the surface of the substrate 510. Rows of brush elements are arranged in parallel in slots that are approximately 0.50 inches from center of the slot to the center of the slot FIG. 6 is a schematic view 600 of a stack of crimped filaments 405, 406 resting on a metal housing 201 and a wire 601 placed on the stack of crimped filaments prior to bending and deforming the metal housing 201. It will be understood by those skilled in the art that the wire 601 runs the length of the brush element as illustrated in FIG. 7. FIG. 7 is a schematic cross-sectional view 700 of the crimped filaments 101 together with the deformed metal housing 201 and wire 601 of FIG. 6.

Figure 8:
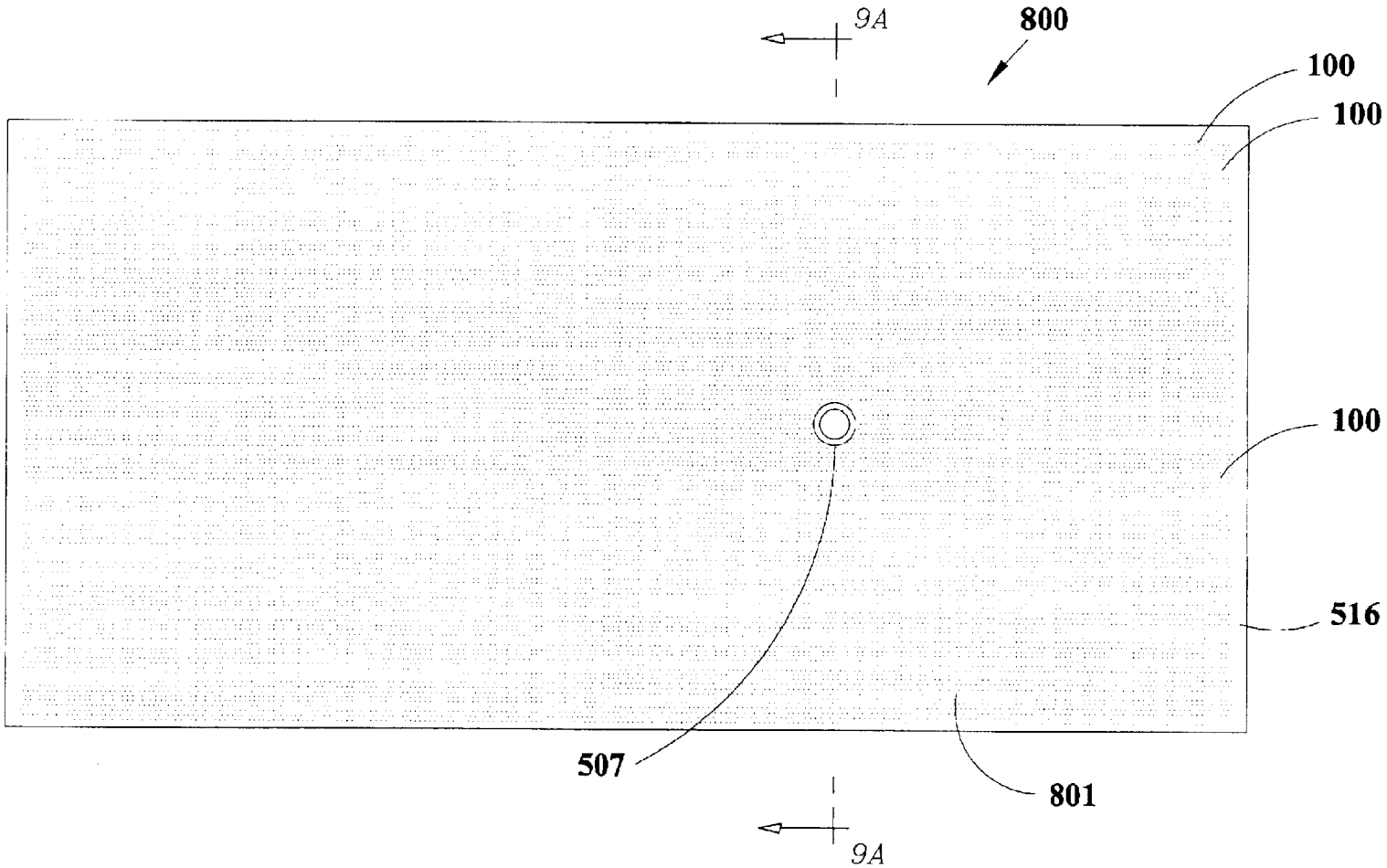
FIG. 8 is a schematic top view of the substrate together with the brush elements in place.

FIG. 8 is a schematic top view 800 of the substrate 510 together with a plurality of brush elements 100 secured thereto. Surface 801 is a homogeneous surface as the filaments 101 of one brush element 100 mesh with the filaments 101 of the adjacent brush element 100. Latch 516 is also depicted at one end of the substrate for securing the brush elements in place. The brush elements may be removed and replaced by simply removing the latch 516. Other forms of securement may be used, for instance, a rod may be used to secure the metal housings to the substrate by drilling a hole through the substrate and metal housings in the middle of the substrate.

The substrate as depicted in FIG. 8 may be in any practical dimension. Groups of substrates may be linked together to form a putting surface or a large fairway surface.

FIG. 9A is a cross-sectional view 900A taken along the lines 9A—9A of FIG. 8 illustrating the brush elements 100 forming a homogeneous surface 801. Lands 508 between the slots 501 are clearly shown. Spaces 901, which are approximately triangular, exist between the brush elements and permit the temporary deformation of one brush element or a group of brush elements when struck by a golf club head. As illustrated in FIG. 9A, the brush elements are approximately 0.50 inches from center line to center line apart and the filaments extend approximately 0.75 inches above lands 508. The geometry of embodiment of FIG. 9A has been found to emulate fairway golf turf well and to provide a homogeneous surface 801 which does not permanently deform after repeated use. The geometry of the embodiment of FIG. 9A enable use with an iron and specifically enables the head of the golf club to penetrate the surface without shock to the user's hands, arms and body. Other geometric configurations may be used.

Figure 9B:
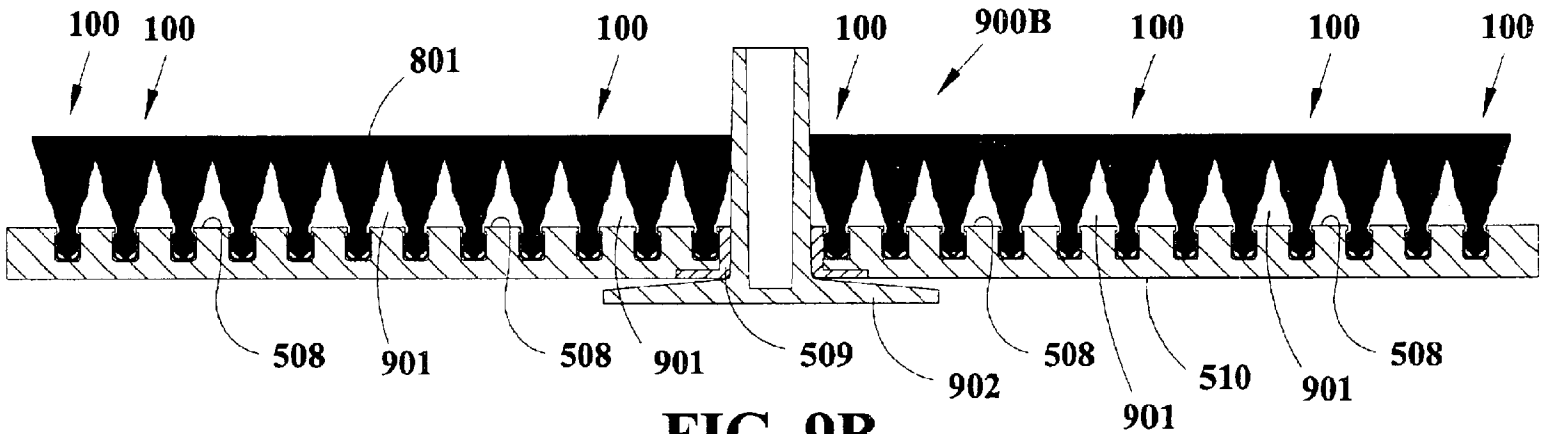
FIG. 9B is a cross-sectional view similar to FIG. 9A with a tee extending beneath the substrate.

Still referring to FIG. 9A, spaces 901 permit the flow of water along the lands 508 and out the ends 505, 506 of the substrate 510. FIG. 9B is a cross-sectional view 900B similar to FIG. 9A with a tee 902 extending beneath the substrate. The tee may assist in orienting the substrate and preventing it from slipping under the force of a swinging golf club head if a small substrate is being used. However, a plastic substrate which is two feet long, one foot wide, and 0.25 inches high together with the weight of 25 brush elements has been found to have enough inertia such that it will not move when struck by a golf club head.

When using the device, the golf club head may penetrate the homogeneous surface formed by the brush elements without substantially uncovering the lands 508 due to the interaction of the filaments.

Figure 9C:
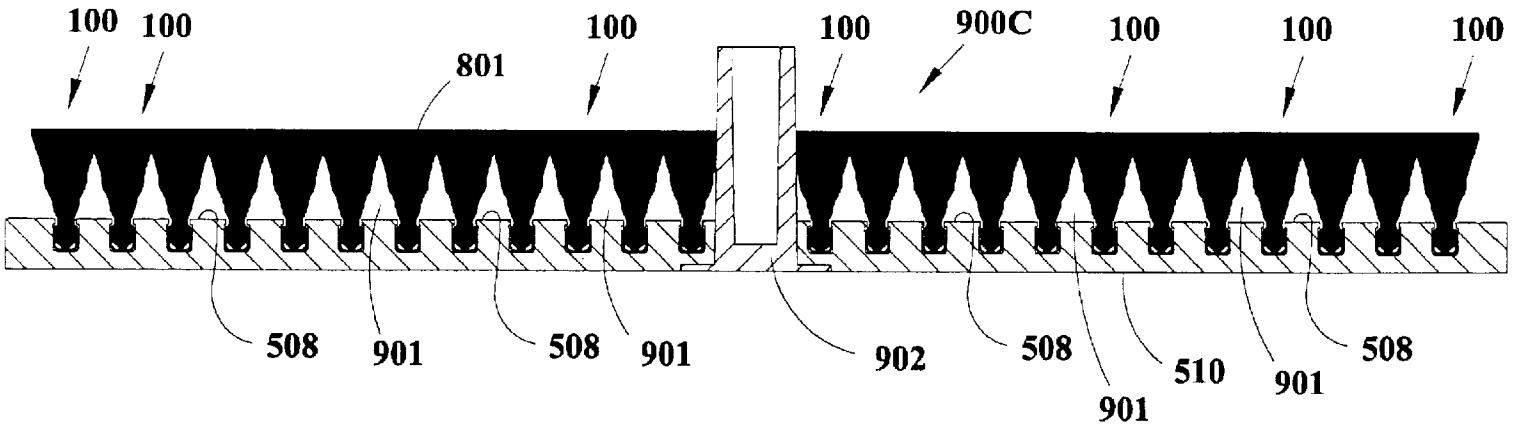
FIG. 9C is a cross-sectional view similar to FIG. 9A illustrating a tee without a bushing in the substrate.
Figure 9D:
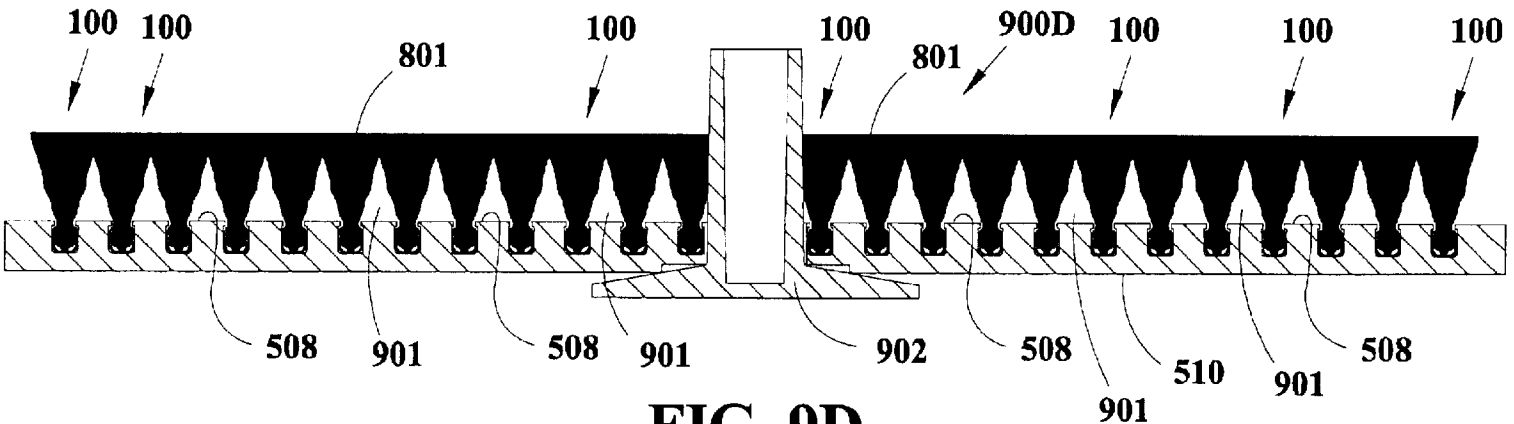
FIG. 9D is a cross-sectional view similar to FIG. 9B illustrating a tee without a bushing.

FIG. 9C is a cross-sectional view 900C similar to FIG. 9A illustrating a tee 902 without a bushing in the substrate. FIG. 9D is a cross-sectional view 900D similar to FIG. 9B illustrating a tee without a bushing.

The invention has been described with particularity by way of example as set forth above. Those skilled in the art will readily recognize that changes may be made to the invention as described herein without departing from the spirit and scope of the claims which follow herein below.

We claim:

1. Golf turf comprising a substrate and a plurality of brush elements retained by said substrate, each of said brush elements comprises a plurality of filaments arranged in a self contained row, each of said brush elements are spaced apart from one another and interengage the adjacent brush element so as to create a homogeneous surface.

2. Golf turf as claimed in claim 1 wherein said brush elements include crimped filaments.

3. Golf turf as claimed in claim 2 wherein said brush elements further include a metal housing and wire for retaining said crimped filaments.

4. Golf turf as claimed in claim 3 wherein said filaments extend outside said metal housing.

5. Golf turf as claimed in claim 4 wherein said filaments flare as they extend outside said metal housing.

6. Golf turf as claimed in claim 1 wherein said brush elements include straight filaments.

7. Golf turf as claimed in claim 6 wherein said brush elements further include a metal housing and wire for retaining said straight filaments.

8. Golf turf as claimed in claim 7 wherein said filaments extend outside said metal housing.

9. Golf turf as claimed in claim 8 wherein said filaments flare as they extend outside said metal housing.

10. Golf turf as claimed in claim 1 wherein said filaments of each brush element interengage said filaments of said adjacent brush element.

11. Golf turf as claimed in claim 10 wherein each of said brush elements includes a housing and said substrate includes slots therein, said housings of said brush elements being retained by said slots of said substrate.

12. Golf turf as claimed in claim 10 wherein said filaments are synthetic resinous filaments.

13. Golf turf as claimed in claim 10 wherein said filaments are selected from the group of nylon and polyester.

14. Golf turf as claimed in claim 10 wherein each of said filaments has a diameter in the range of 0.006 to 0.020 inches.

15. Golf turf as claimed in claim 10 wherein each of said filaments is crimped in the form of a sine wave having a frequency of 3 cycles per inch.

16. Golf turf as claimed in claim 10 wherein each of said filaments is crimped in the form of a sine wave having a frequency of 0.5 to 6 cycles per inch.

17. Golf turf comprising a substrate and a plurality of brush elements retained by said substrate; each of said brush elements are spaced apart from one another and oriented parallel to each other; each of said brush elements include filaments, a metal housing and wire for retaining said filaments; said filaments extend outside said metal housings; said filaments flare as they extend outside said metal housing; said filaments of each brush interengage said filaments of said adjacent brush.

18. Golf turf as claimed in claim 17 wherein each of said filaments has a diameter in the range of 0.006 to 0.020 inches.

19. Golf turf as claimed in claim 17 wherein each of said filaments is crimped in the form of a sine wave having a frequency of 3 cycles per inch.

20. A process for making golf turf comprising the steps of:

forming self contained brush strips from crimped filaments;

inserting said self contained brush strips in a substrate;

locking said self contained brush strips in said substrate; and, wherein said step of forming said self contained brush strips further comprises the steps of;

laying a flat piece of metal on a surface;

placing synthetic resinous filaments on said metal;

placing a wire on top of said filaments; and, deforming said flat piece of metal into a housing so as to entrap said filaments and said wire.

* * * * *